US007347624B2

(12) United States Patent
Savicki, Sr. et al.

(10) Patent No.: US 7,347,624 B2
(45) Date of Patent: Mar. 25, 2008

(54) TIE BAG

(75) Inventors: Alan F. Savicki, Sr., Oswego, IL (US); Tim L. LaRocque, Oak Forest, IL (US)

(73) Assignee: The Glad Products Company, Oakland, CA (US)

( * ) Notice: Subject to any disclaimer, the term of this patent is extended or adjusted under 35 U.S.C. 154(b) by 403 days.

(21) Appl. No.: 10/835,970

(22) Filed: Apr. 30, 2004

(65) Prior Publication Data

US 2005/0244085 A1 Nov. 3, 2005

(51) Int. Cl.
*B65D 33/16* (2006.01)
*B65D 33/06* (2006.01)

(52) U.S. Cl. ..... 383/77; 383/14; 383/62

(58) Field of Classification Search ..... 383/77, 383/75, 24, 62, 14, 8; 220/495.1, 495.11
See application file for complete search history.

(56) References Cited

U.S. PATENT DOCUMENTS 2,565,283 A * 8/1951 Throckmorton ..... 383/75
3,292,813 A * 12/1966 Roegner ..... 220/495.11
3,664,575 A * 5/1972 Lake ..... 383/62
3,779,139 A * 12/1973 White ..... 493/194
3,865,303 A * 2/1975 Korn ..... 383/62
3,979,050 A 9/1976 Cilia
4,338,979 A 7/1982 Dow
4,570,304 A 2/1986 Montreuil et al.
4,680,808 A * 7/1987 Paleschuck ..... 383/9
4,764,029 A * 8/1988 Abblett ..... 383/104
4,778,283 A * 10/1988 Osborn ..... 383/71
4,811,418 A * 3/1989 Reifenhauser ..... 383/10
4,953,704 A 9/1990 Cortese
4,989,994 A 2/1991 Gelbard
5,133,607 A 7/1992 Bonke
5,246,110 A * 9/1993 Greyvenstein ..... 206/390
5,346,311 A * 9/1994 Siler et al. ..... 383/75
6,220,753 B1 4/2001 Metzger
6,398,411 B2 6/2002 Metzger
6,402,377 B1 6/2002 Vo et al.
D467,169 S 12/2002 Felter
6,513,975 B1 2/2003 Jackson et al.
6,537,408 B1 * 3/2003 Rossiter ..... 156/212
6,561,696 B1 5/2003 Rusnak et al.
6,565,794 B1 5/2003 Fraser
6,585,415 B2 7/2003 Malaspina
6,602,174 B1 8/2003 Haverfield et al.
6,629,622 B1 10/2003 Abzaletdinov
6,695,476 B2 2/2004 Jackson et al.
2002/0113174 A1 8/2002 Tomlin
2002/0191871 A1 12/2002 Malaspine

* cited by examiner

*Primary Examiner*—Jes F. Pascua
(74) *Attorney, Agent, or Firm*—Thomas Feix; Alok Goel

(57) ABSTRACT

A tie bag includes a hem seal, at the mouth of the bag, which grips the top of a receptacle, when the tie bag is used as a liner for the receptacle, to preclude having the mouth of the bag fall into the receptacle. The hem seal forms a hem flap, which is cut in a geometric pattern to provide tie fasteners. The hem seal may also form a hem at the open mouth of the tie bag. The tie bag may further include a pair of secondary hem seals closing the hem at the opposing sides of the sidewalls.

15 Claims, 7 Drawing Sheets

TIE BAG

FIELD OF THE INVENTION

This invention relates to plastic bags having ties adjacent an open mouth of the bag for closing the bag, and more particularly to such bags used as liners for a container, such as a trash receptacle.

BACKGROUND OF THE INVENTION

The manufacture and use of plastic storage and disposal bags having tie features which are integral with a container portion of the bag for tying the mouth of the bag closed is known in the art. These tie features typically consist of a geometrically cut out portion of the sidewalls of the bag, that forms two or more ties joined by a bight, which can be grasped and knotted to seal the bag. Bags having such integral ties are sometimes referred to as "tie bags."

The ties typically extend above a container portion of the bag, which is used for holding the bag contents. The ties provide a closure means for tying the mouth of the bag closed, after the contents have been placed in the bag.

It is desirable to use tie bags as liners for receptacles, such as trash receptacles. When tie bags, or any bag for that matter, is used as a liner for a receptacle, the container portion of the bag is typically placed inside of the receptacle, with the mouth of the bag draped over the rim of the receptacle, to keep the bag suspended in the receptacle.

It is further desirable for a tie bag, which is to be used as a liner, to include provisions for keeping the mouth of the bag from falling into the receptacle, while the bag is being filled with contents. Having the mouth of the bag fall into the receptacle is a source of considerable annoyance for the consumer, who must then reach into the receptacle and pull the mouth of the bag back up over the rim of the receptacle. In the case of a trash receptacle, this can be particularly unpleasant task. Furthermore, if a consumer does not notice that the mouth of the bag has fallen into the receptacle, additional contents may be deposited in the receptacle on top of the fallen liner rather than being contained within the bag and sully the interior of the receptacle. This defeats the purpose of using the bag as a liner for the receptacle.

BRIEF SUMMARY OF THE INVENTION

The invention provides an improved tie bag including a hem seal at the mouth of the bag, which grips the top of a receptacle when the tie bag is used as a liner for the receptacle, to preclude having the mouth of the bag fall into the receptacle.

In one form of the invention, a tie bag includes a container portion defining an open mouth of the tie bag having a hem seal that forms a hem flap, with the hem flap being cut in a geometric pattern to provide tie fasteners. The container portion may include two opposing sidewalls, each defining a periphery thereof, with the peripheries being joined to form the container portion and define the open mouth of the tie bag. The sidewalls may be joined to each other along a pair of opposing sides and a bottom bridging the opposing sides, with a top of each respective sidewall being folded over toward the bottom and joined to its respective sidewall by the hem seam to form the hem flap.

The hem seal may form a hem at the open mouth of the tie bag. The tie bag may further include a pair of secondary hem seals closing the hem at the opposing sides of the sidewalls.

The geometric pattern of the hem flap may define at least two tie fasteners joined by a bight. In various forms of the invention, the hem seal may be located to intersect the bight, when the top of the sidewalls is folded over toward the bottom, or to be above or below the bight, when the top of the sidewalls is folded over toward the bottom.

Other objectives and advantages of the invention will be apparent from the following detailed description and accompanying drawings.

While the invention is described herein in reference to certain embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
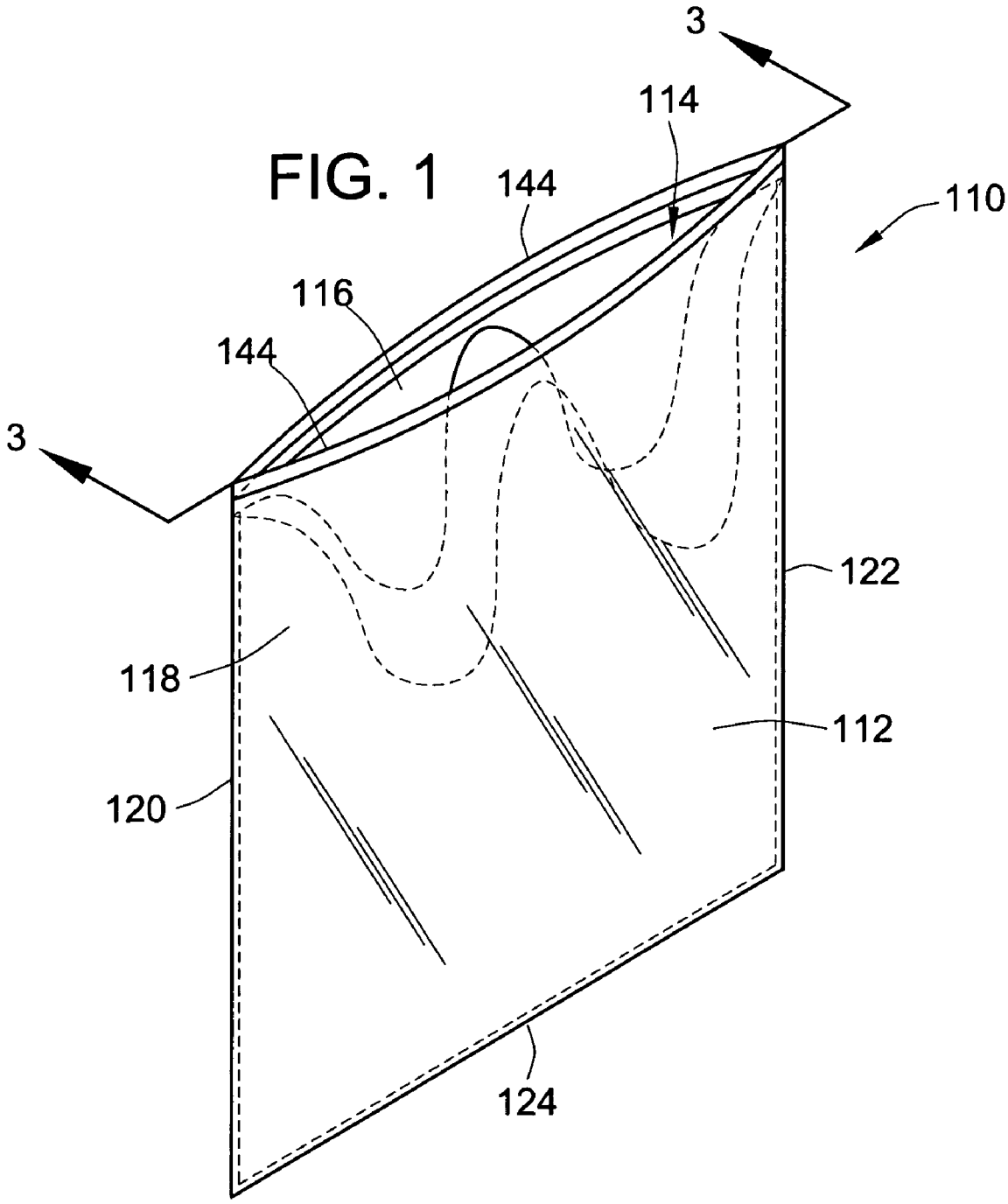
FIG. 1 is a perspective view of a first exemplary embodiment of a tie bag, according to the invention, having a container portion defining an open mouth including a hem seal that forms a hem flap, with the hem flap being cut in a geometric pattern to provide tie fasteners.

FIG. 1 shows a first exemplary embodiment of the invention, in the form of a tie bag 110, having a container portion 112 including an open mouth 114. The container portion 112 includes a first and a second opposing sidewalls 116, 118 with a pair of opposing sides 120, 122 and a bottom 124 joined to form the container portion 112. The peripheries of the first and second sidewalls 116, 118 each include a respective top 126, as shown in FIG. 2.

Figure 2:
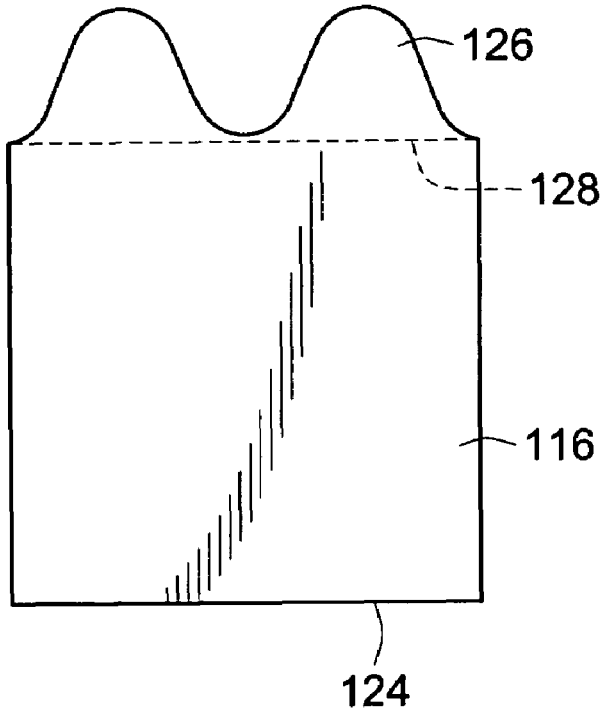
FIG. 2 is a view of an inside surface of a sidewall of the tie bag of FIG. 1, showing the sidewall prior to folding the top of the sidewall over and forming the hem seal.
Figure 3:
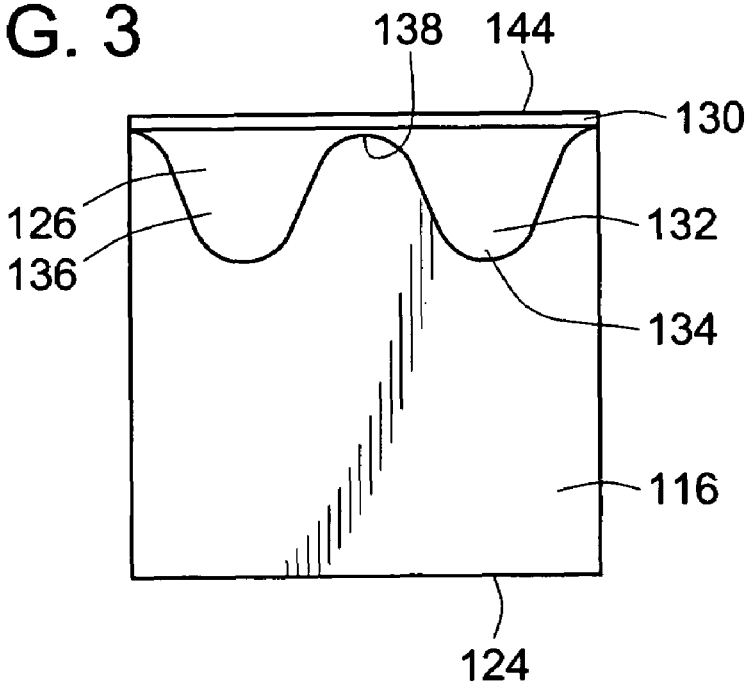
FIG. 3 is a view of an inside surface of the sidewall of FIG. 2, taken along lines 3-3 as shown in FIG. 1, showing the sidewall after folding the top of the sidewall over into the container portion and forming the hem seal.

As shown in FIGS. 2 and 3, the top 126 of each sidewalls 116, 118 is folded over toward the bottom 124, about a fold line 128, and joined to its respective sidewall 116, 118 by a hem seal 130, to form a hem flap 132. The hem seals 130 may be formed by a heat sealing process, adhesive bonding, or by other sealing processes known in the art.

As shown in FIG. 3, the hem flaps 132 are cut in a geometric pattern to provide at least two ties 134, 136 joined by a bight 138. In the exemplary embodiments shown herein, the geometric pattern is sinusoidal, but other serpentine or notched patterns can be used with equal efficacy in other embodiments of the invention. It will also be noted that in the exemplary embodiments shown herein, the ties 134, 136 on both sidewalls 116, 118 are identical, and therefore overlap one another when the bag 110 is folded flat. In other embodiments of the invention, the ties 134, 136 extending from the sidewall 116 may not overlap with the ties 134, 136 of sidewall 118. It is further noted, that although the exemplary embodiments shown herein utilize four ties, other embodiments of the invention may utilize a different number of ties, such as two or three ties.

Figure 4:
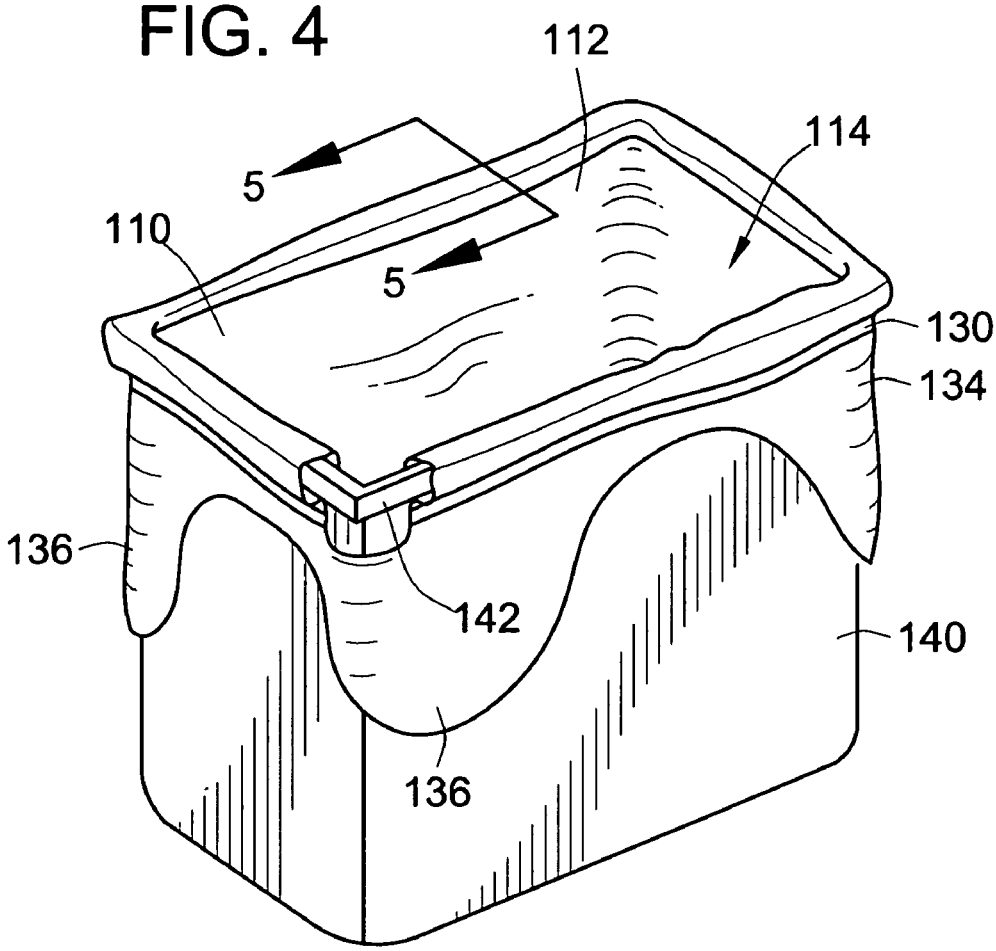
FIG. 4 is a perspective view of the tie bag of FIG. 1, installed as a liner in a receptacle with a portion of the bag cut away to show a corner of the receptacle.
Figure 5:
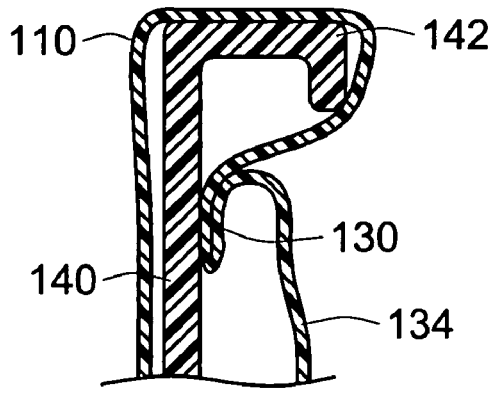
FIG. 5 is a cross sectional view of a portion of the rim of the receptacle, taken along line 5-5 of FIG. 4, showing the hem seal gripping the outside of the receptacle.

As shown in FIGS. 4 and 5, when the bag 110 is used as a liner in a receptacle 140, with container portion 112 of the bag 110 hanging in the receptacle 140 and the mouth 114 pulled over a rim 142 of the receptacle 140, the hem seals 130 grip the outer surface of the receptacle 140, to preclude having the bag 110 fall back into the receptacle 140. As shown in FIG. 4, the hem seal 130 doubles the layers of film to be stretched across the rim 142 of the receptacle which may double the grip force of the bag. As currently understood, when stretching a plastic film for relatively small amounts of stretch, there exists a resistance to stretching up until the yield point. Therefore, by having two layers of film from the hem seal, the amount of yield force may double and, thus, the amount of grip force may double. Consequently, the bag will hold tighter onto the receptacle.

Figure 6:
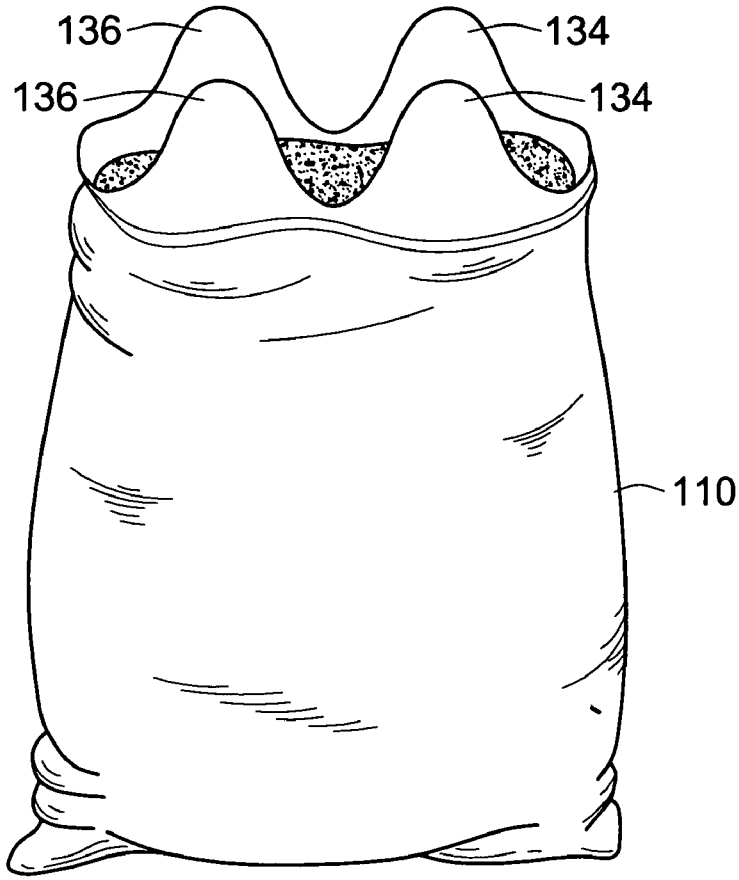
FIGS. 6 and 7 are perspective views of the tie bag removed from the receptacle, after being filled with contents.
Figure 7:
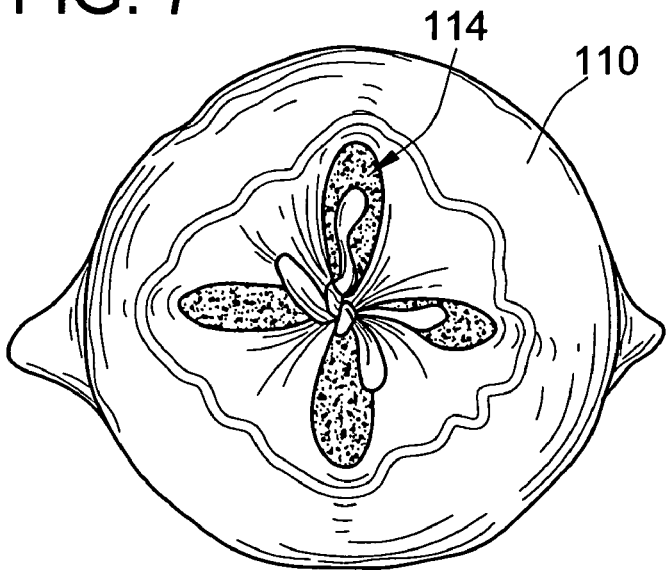

The ties 134, 136 are used in the conventional manner, as shown in FIGS. 6 and 7, to pull the bag 110 out of the receptacle 140, and to close the mouth 114 of the bag 110 by being knotted together.

Figure 8:
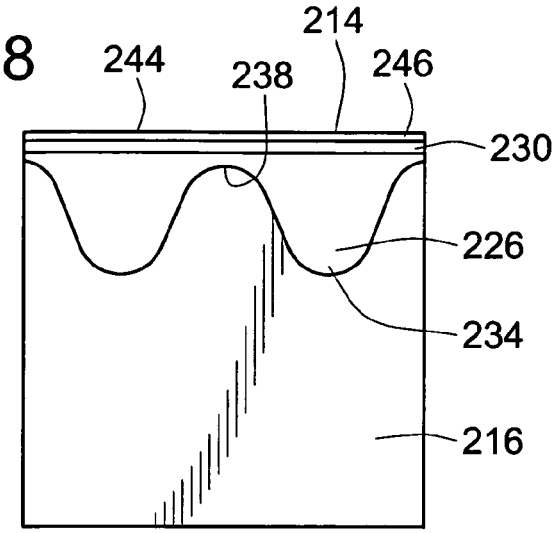
FIGS. 8 and 9 show other embodiments for folding the top of the sidewall, and locations for the hem seal.
Figure 9:
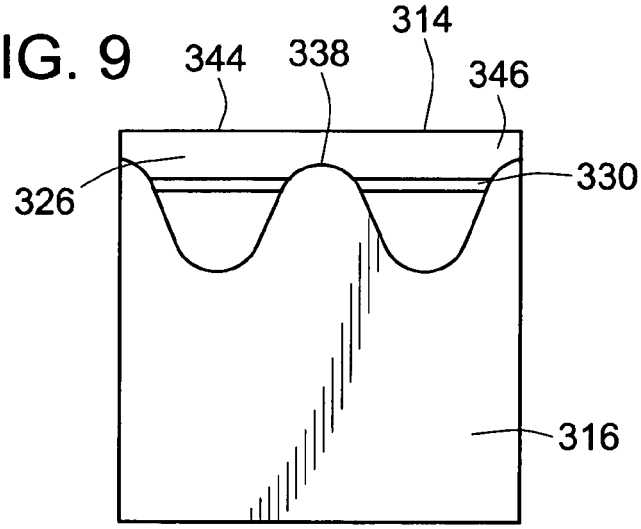

FIGS. 8 and 9 show other embodiments of the invention, in which the distance that the tops 126 of the sidewalls 116, 118 are folded toward the bottom 124, and the location of the hem seal 130 with respect to the bight 138 are different from the embodiment shown in FIG. 3.

In the embodiment shown in FIG. 3, the top 126 of the sidewall 116 is folded in a manner that results in the bight 38 being located close to a distal edge 144 of the mouth 114, and the hem seal 130 is positioned to intersect the bight 138. With the hem seal 130 positioned in this manner, the top 126 of the sidewalls 116 is essentially folded back upon the sidewall 116 and joined to the sidewall 126 by the hem seal 130 in such a manner that the distal edge 144 of the mouth 114 is fused together into a band of material, having an increased thickness, extending around the mouth 114 of the bag 110.

In the embodiment of FIG. 8, the top 226 of the sidewall 216 is folded in a manner that results in the bight 238 being located at a greater distance from the distal edge 244 of the mouth 214 than was the case in the embodiment of FIG. 3, and the hem seal 230 is positioned between the bight 238 and the distal edge 244, to thereby form a hem 246 on each of the sidewalls.

In the embodiment of FIG. 9, the top 326 of the sidewall 316 is folded in a manner that results in the bight 338 being located at a distance from the distal edge 344 of the mouth 314 that is similar to the distance shown in FIG. 8, and the hem seal 330 is positioned below the bight 338, to thereby form a hem 346 on the sidewall 316.

Figure 12:
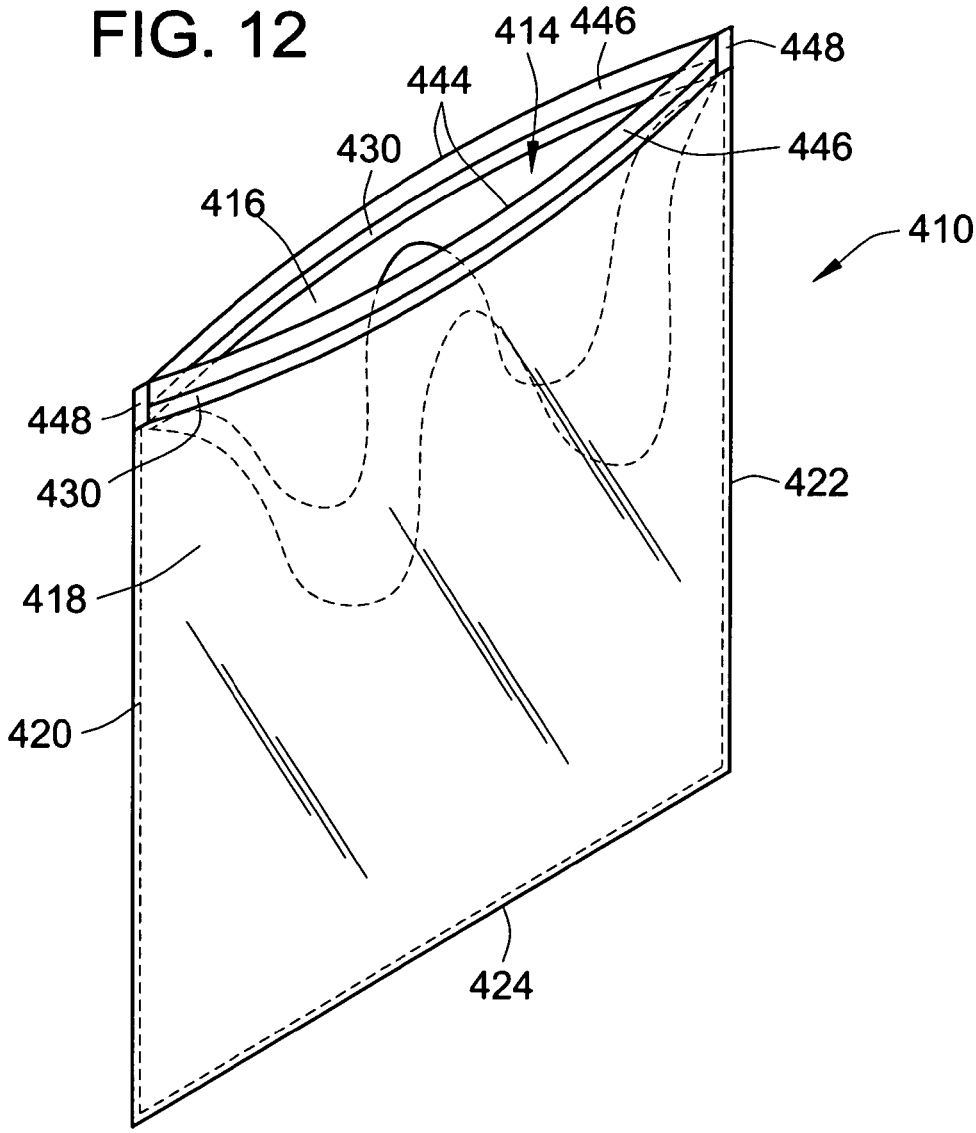
FIG. 12 is a perspective view of another embodiment of a tie bag, according to the invention, having a pair of secondary hem seals for closing hems along the mouth of the bag at opposing sides of the tie bag.

FIG. 12 shows another embodiment of a bag 410, having the hem seals 430 positioned to form a hem 446 at each of the distal edges 444 of the mouth 414. The embodiment of FIG. 12 also includes a pair of secondary hem seals 448 at the opposing sides 420, 422 of the sidewalls 416, 418. It is contemplated that a secondary hem seal 448 having a width of about one quarter inch, and merging into the hem seals 430 would be preferred for a tie bag 410 used in a standard sized trash receptacle.

The foregoing description of exemplary embodiments of the invention has been presented for purposes of illustration and description. It is not intended to be exhaustive or to limit the invention to the precise embodiments disclosed.

Figure 10:
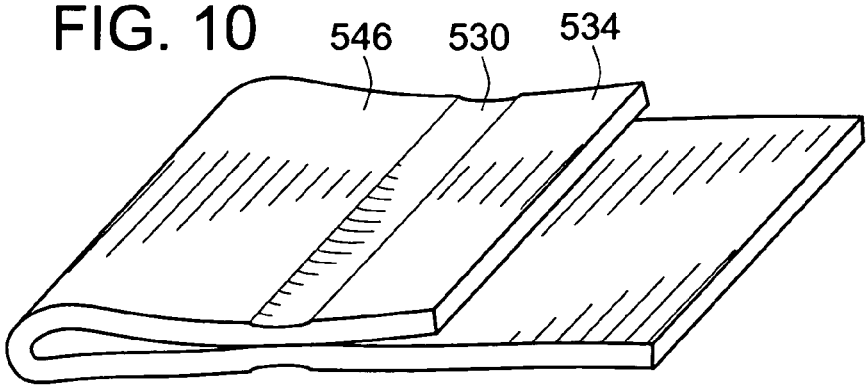
FIG. 10 is a perspective view of a hem formed in a sidewall of a tie bag by a continuous hem seal, according to the invention.
Figure 11:
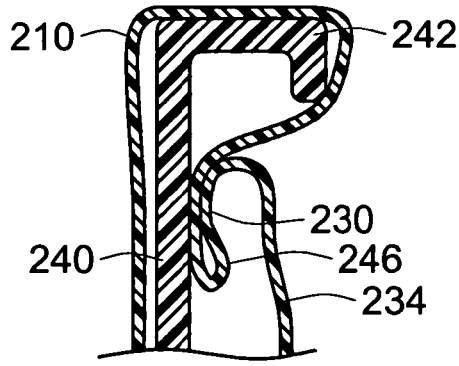
FIG. 11 is a cross sectional view of a portion of the rim of a receptacle, showing a tie bag having a hem at the mouth of the bag created by a hem seal as shown in FIG. 8, installed as a liner in the receptacle.
Figure 13:
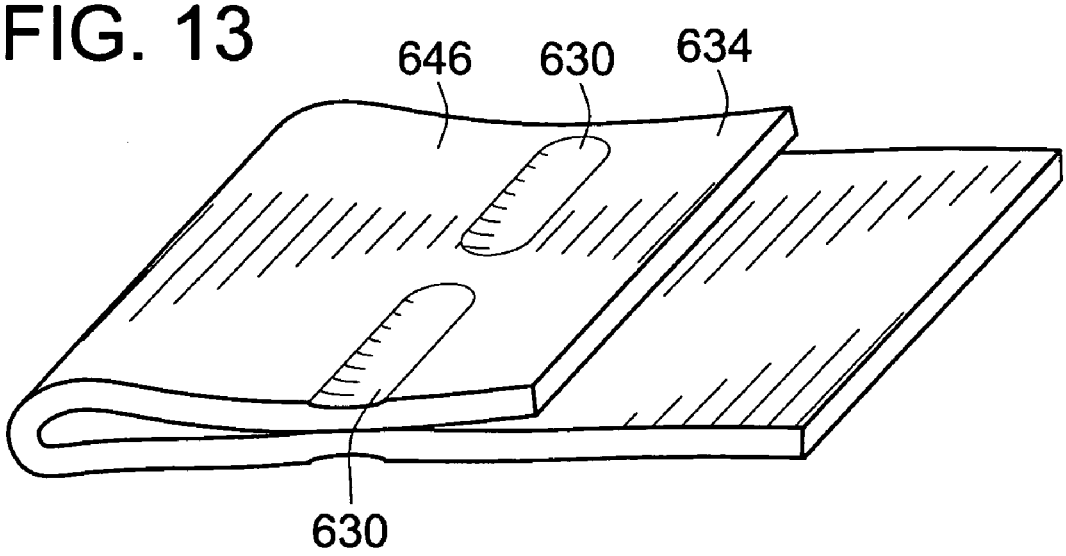
FIG. 13 is a perspective view of a hem formed in a sidewall of a tie bag, by a intermittent hem seal, according to the invention.
Figure 14:
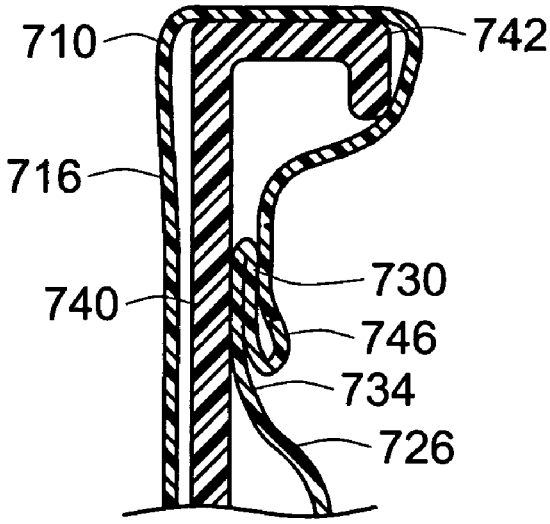
FIG. 14 is a cross sectional view of an alternate exemplary embodiment of a tie bag, according to the invention, having the top of the sidewall folded outward and joined to the sidewall by a hem seal, rather than being folded inward and joined to the sidewall by a hem seal, as shown in the exemplary embodiments of FIGS. 1-13.

Numerous modifications or variations are possible in light of the above teachings. For example, the hem seal may be either a continuous hem seal 530, as shown in FIG. 10, or an intermittent hem seal 630, as shown in FIG. 13. As another example, the tops 726 of the sidewall 716 may be folded outward toward the bottom, as shown in FIG. 14, rather than inward as is shown in the FIG. 5. Thus, when the bag 710 is used as a liner in a receptacle 740, the tie 734 will hang directly downward from the hem seal 730, as shown in FIG. 14, rather than folding back over the hem seal 130, as shown in FIG. 5.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tie bag comprising a container portion including an open mouth and a hem seal that form a hem flap, the hem flap being cut in a geometric pattern to provide tie fasteners;

the container portion includes two opposing sidewalls, each defining a periphery thereof joined to form the container portion and the open mouth of the tie bag;

the sidewalls are joined to each other along a pair of opposing sides and a bottom bridging the opposing sides, and a top of each respective sidewall is folded over toward the bottom and joined to its respective sidewall by the hem seal to form the hem flap;

the geometric pattern of the hem flap includes a pair of tie fasteners joined by a bight; and the hem seal is disposed below the bight when the top of the sidewalls is folded over toward the bottom.

2. The tie bag of claim 1 wherein the geometric pattern is a sinusoidal pattern.

3. The tie bag of claim 1 wherein the hem seal forms a hem at the open mouth of the tie bag.

4. The tie bag of claim 3 further comprising a pair of secondary hem seals closing the hem at the opposing sides of the sidewalls.

5. The tie bag of claim 4 wherein the secondary hem seals are about one quaffer inch in width.

6. A tie bag comprising a container portion including an open mouth and a hem seal that form a hem flap, the hem flap being cut in a geometric pattern to provide tie fasteners;

the container portion includes two opposing sidewalls, each defining a periphery thereof joined to form the container portion and the open mouth of the tie bag;

the sidewalls are joined to each other along a pair of opposing sides and a bottom bridging the opposing sides, and a top of each respective sidewall is folded over toward the bottom and joined to its respective sidewall by the hem seal to form the hem flap;

the geometric pattern of the hem flap includes a pair of tie fasteners joined by a bight; and the hem seal intersects the bight when the top of the sidewalls is folded over toward the bottom.

7. The tie bag of claim 6 wherein the hem seal forms a hem at the open mouth of the tie bag.

8. The tie bag of claim 7 further comprising a pair of secondary hem seals closing the hem at the opposing sides of the sidewalls.

9. A tie bag comprising a container portion including an open mouth and a hem seal that form a hem flap, the hem flap being cut in a geometric pattern to provide tie fasteners;

the container portion includes two opposing sidewalls, each defining a periphery thereof joined to form the container portion and the open mouth of the tie bag;

the sidewalls are joined to each other along a pair of opposing sides and a top and a bottom bridging the opposing sides, the top of each respective sidewall is folded over toward the bottom and joined to its respective sidewall by the hem seal to form the hem flap;

the geometric pattern of the hem flap includes a pair of tie fasteners joined by a bight;

the hem seal is disposed above the bight when the top of the sidewalls is folded over toward the bottom; and whereby the hem seal doubles the layers of a film to be stretched when a user pulls the open mouth of the tie bag over a rim of a trash receptacle and thereby improves the grip force of the bag.

10. The tie bag of claim 9 wherein the hem seal forms a hem at the open mouth of the tie bag.

11. The tie bag of claim 10 further comprising a pair of secondary hem seals closing the hem at the opposing sides of the sidewalls.

12. A tie bag comprising:

a container portion including an open mouth of the tie bag and a pair of hem seals that form a pair of hem flaps;

the hem flaps being cut in a geometric pattern to provide at least two tie fasteners joined by a bight;

the container portion including a first and a second opposing sidewall, each having a pair of opposing sides and a bottom joined to form the container portion and the open mouth of the tie bag; and the peripheries of the first and second sidewalls each including a respective top thereof that is folded over toward the bottom and joined to its respective sidewall by one or the other of the hem seals to form the hem flaps.

13. The tie bag of claim 12 wherein the tops of the first and second sidewalls are folded inward, between the first and second sidewalls, with the top of the first sidewall being joined to an interior surface of the first sidewall by one of the hem seals, and the top of the second sidewall being joined to an interior surface of the second sidewall by the other of the hem seals.

14. The tie bag of claim 12 wherein the pair of hem seals forms a pair of hems at the open mouth of the tie bag.

15. The tie bag of claim 14 further comprising a pair of secondary hem seals closing the pair of hems at the opposing sides of the sidewalls.

* * * * *